US005853205A

United States Patent [19]

Enomoto et al.

[11] Patent Number: 5,853,205

[45] Date of Patent: Dec. 29, 1998

[54] APPARATUS HAVING BODY, COVER, AND LOCKING MECHANISM

[75] Inventors: Hideki Enomoto; Kenichi Egawa, both of Tokyo, Japan

[73] Assignee: OkiData Corporation, Tokyo, Japan

[21] Appl. No.: 804,161

[22] Filed: Feb. 20, 1997

[30] Foreign Application Priority Data

Feb. 29, 1996 [JP] Japan ..... 8-042508

[51] Int. Cl.[6] ..... E05C 19/06

[52] U.S. Cl. ..... 292/87; 292/DIG. 38

[58] Field of Search ..... 292/87, DIG. 38, 292/19, 80, 81; 220/263–264, 793

[56] References Cited

U.S. PATENT DOCUMENTS

| | | | |
|---|---|---|---|
| 1,244,683 | 10/1917 | Ambruster | 292/87 |
| 4,344,646 | 8/1982 | Michel | 292/87 |
| 4,521,050 | 6/1985 | Rea | 292/87 |
| 4,890,742 | 1/1990 | Allison | 292/DIG. 38 |
| 4,964,661 | 10/1990 | Cadwell | 292/DIG. 38 |
| 5,233,506 | 8/1993 | Semenik | 292/81 |
| 5,553,701 | 9/1996 | Jarecki | 220/793 |

*Primary Examiner*—Flemming Saether
*Attorney, Agent, or Firm*—Panitch Schwarze Jacobs & Nadel, P.C.

[57] ABSTRACT

A locking mechanism of the present invention is for locking a cover to a body of an apparatus when the cover closes the body. The locking mechanism includes a strip-shaped portion having a free end portion and an engagement hole into which the free end portion projects when the cover is closed. The strip-shaped portion is formed on the cover and engages the body to resiliently deform when the cover is moved in a closing direction in which the cover closes the body. The strip-shaped portion engages the body to resiliently deform when the cover is moved in an opening direction in which the cover opens the body. The opening direction is opposite to the closing direction. The body has a portion defining an engagement hole into which the free end portion projects to engage the wall of the engagement hole when the cover closes the body, and from which the free end portion projects out of the engagement with the wall when the cover is moved in the opening direction.

16 Claims, 9 Drawing Sheets

APPARATUS HAVING BODY, COVER, AND LOCKING MECHANISM

BACKGROUND OF THE INVENTION

The present invention relates to a locking mechanism provided in a printer, and more particularly to a locking mechanism by which the cover of the printer is firmly fitted to the body of the printer.

DESCRIPTION OF RELATED ART

Conventionally, a printer is provided with a cover for covering an opening in the body and a locking mechanism on the chassis for locking the cover to the body. The cover is pivotally mounted to the body and is locked to the body by the locking mechanism when the cover is closed. This type of locking mechanism is usually provided at the left and right sides of chassis. The locking mechanism includes a coil spring, hook mounted on the side portion of the cover, and hole formed in the body at a location where the hook opposes tile holes when the cover is closed. When the cover is rotated to completely close the opening, the hook engages the hole in the body so that the cover is closed in a locking engagement with the body. When opening the cover, the hooks are simultaneously depressed by both hands against the urging forces or the coil springs, thereby causing the hooks to disengage from the holes. Then, the cover is rotated to open.

A problem with The aforementioned conventional locking mechanism is that the operator must use both hands simultaneously to unlock the cover when the cover is to be opened. This is inconvenient.

SUMMARY OF THE INVENTION

An object of the invention is to provide a locking mechanism which allows a cover to be opened by one hand.

A locking mechanism of the present invention is for locking a cover to a body of an apparatus when the cover closes the body. The locking mechanism includes a strip-shaped portion having a free end portion and an engagement hole into which the free end portion projects when the cover is closed. The strip-shaped portion is formed on the cover and engages the body to resiliently deform when the cover is moved in a closing direction in which the cover closes the body. The strip-shaped portion also engages the body when the cover is moved in an opening direction in which the cover opens the body. The opening direction is opposite to the closing direction. The body has a portion defining an engagement hole into which the free end portion projects to engage the wall of the engagement hole when the cover closes the body, and from which the free end portion projects out of the engagement with the wall when the cover is moved in the opening direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
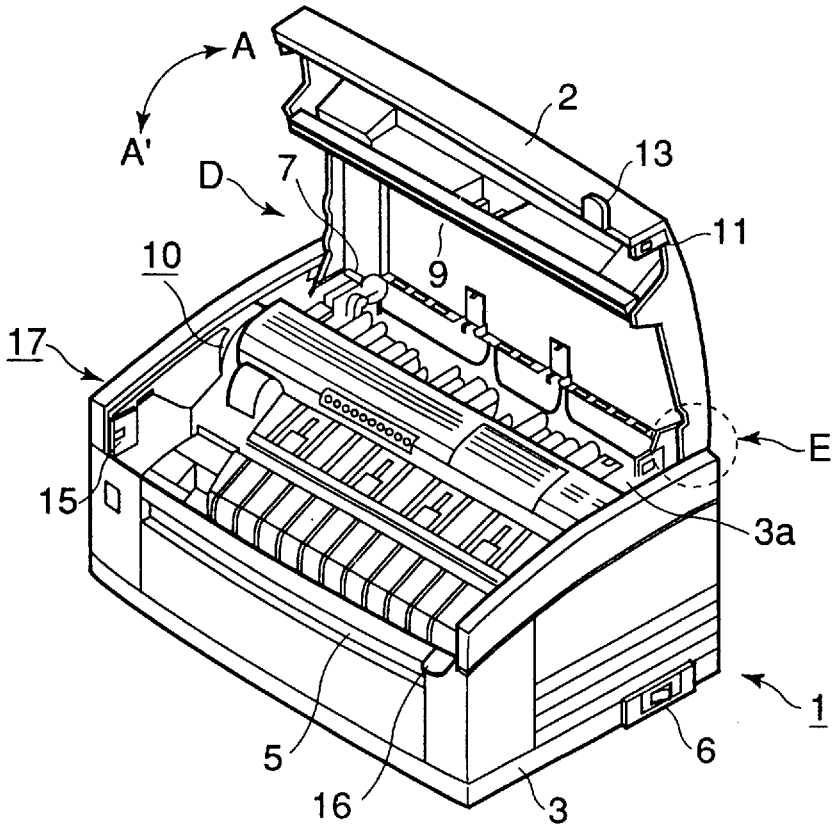
FIG. 1 is a perspective view of an electrophotographic printer according to a first embodiment of the invention, showing the printer when the cover is opened.

Preferred embodiments of the present invention will be described with reference to the drawings. Like elements have been given like reference numerals throughout the drawings.

First Embodiment

Figure 2:
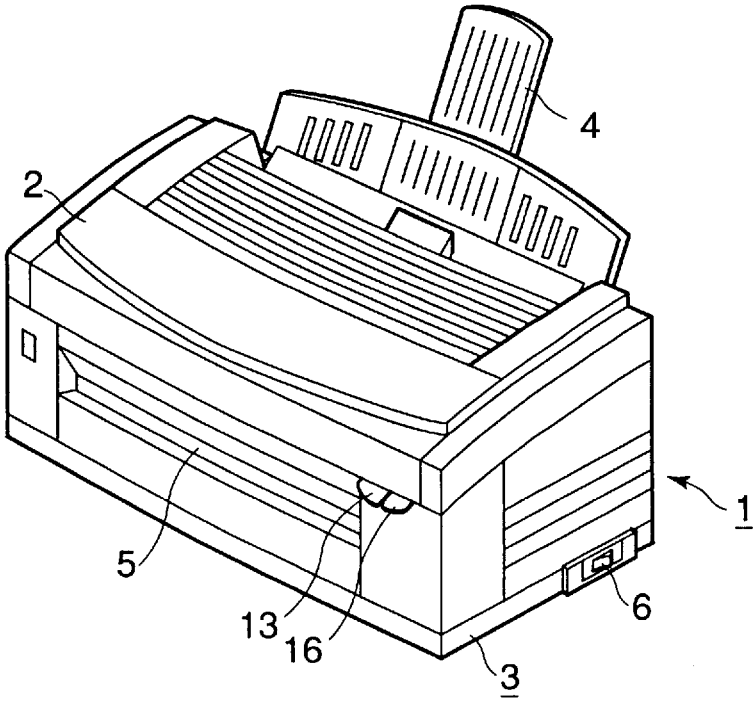
FIG. 2 is a perspective view of the electrophotographic printer of FIG. 1 when the cover is closed.

FIG. 1 is a perspective view of an electrophotographic printer according to the present invention, when the cover is opened. FIG. 2 is a perspective view of the electrophotographic printer when the cover is closed.

Referring to FIG. 2, an electrophotographic printer 1 includes a cover 2 and a body 3. The cover 2 is provided with an exit stacker 4 onto which the printed copy paper is discharged. The body 3 includes at its front a slot 5 through which the copy paper is fed into the printer 1, and a power switch 6 at the right side of the body 3.

Referring to FIG. 1, the cover 2 is mounted to the body so as to cover an opening 3*a*, and is pivotal about a supporting shaft 7 in directions shown by arrows A and A'. The cover 2 has an LED array head 9 mounted on the inner side thereof. The body 3 houses an image process cartridge 10 therein which includes a photosensitive drum, charging device and developer, not shown. When the cover 2 is closed, the LED array head 9 is held in position so that the LED array head 9 cooperates with the image process cartridge 10 to form images. The image process cartridge 10 needs to be replaced when it reaches the end of its useful life.

On the left and right ends or the cover 2 are formed resilient strip-shaped portions 11 and 12 in one piece construction with the cover 2, only hook 11 being depicted in FIG. 1. Provided on the inner sides of the left and right front areas of the body 3 is engagement holes 14 and 15, only the hole 15 being depicted in FIG. 1. The holes 14 and 15 oppose the strip-shaped portions 11 and 12, respectively, when the cover 2 is closed.

Figure 3:
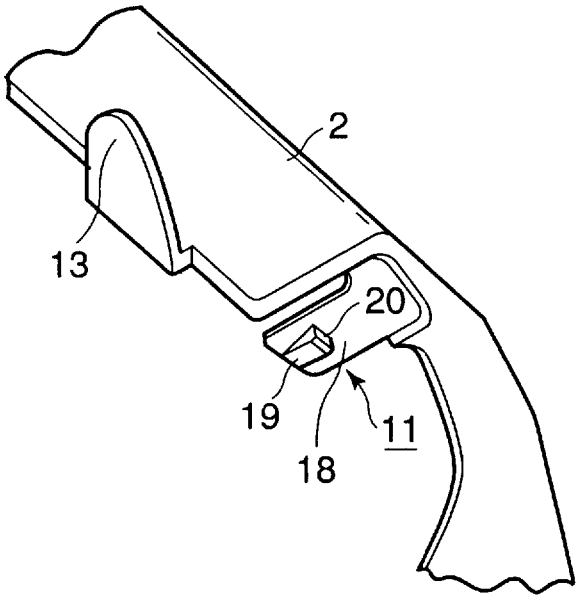
FIG. 3 is a fragmentary perspective view showing a strip-shaped portion of the invention.

FIG. 3 is a fragmentary perspective view showing a strip-shaped portion 11 of the invention. Referring to FIG. 3, the strip-shaped portion 11 includes a thin resilient portion 18, tapered portion 19 that is inwardly tapered toward the free end of the resilient portion 18, and locking surface 20.

Figure 4:
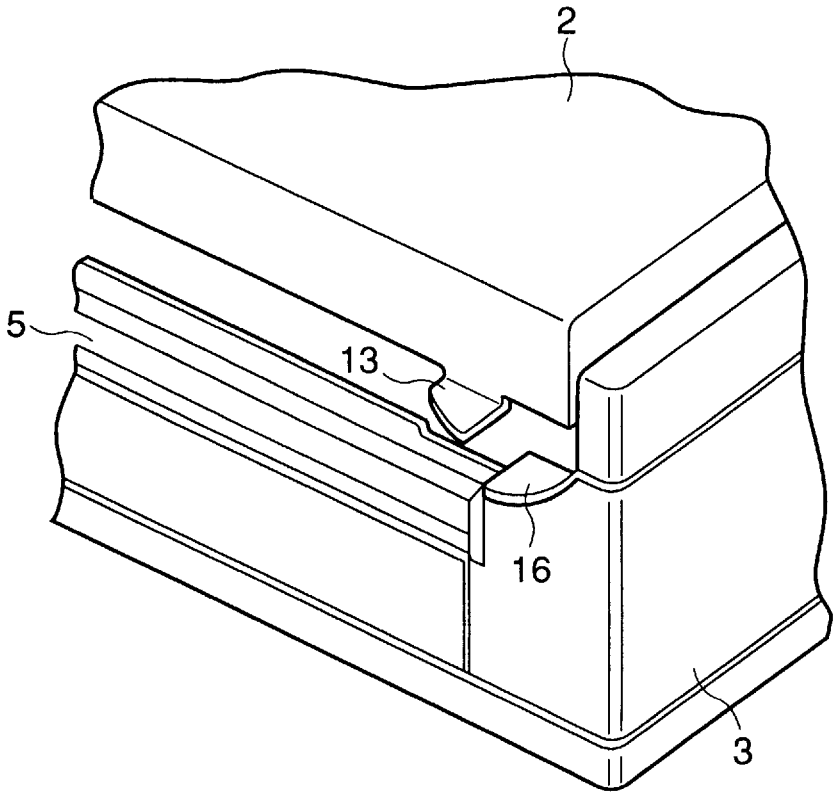
FIG. 4 is a fragmentary perspective view showing projections of the invention which are operated to open the cover.

FIG. 4 is a fragmentary perspective view showing projections 13 and 16 of the invention. Referring to FIG. 4, the cover 2 has a projection 13 at its front edge close to the strip-shaped portion 11, i.e., at the front right-hand side of the printer 1. The body 3 is provided with a projection 16 at the front of the body 3 beside the opening 3*a*. The projection 16 projects forwardly of the printer so that the projections 16 and 13 are side by side and substantially in the same horizontal plane as shown in FIG. 2 when the cover 2 is completely closed. The projections 13 and 16 are in the form of a somewhat thick plate and are in one piece construction with the cover 2 and body 3, respectively. The strip-shaped portion 11, engagement hole 14, and projection 13 form a locking mechanism 17 on the right side and the strip-shaped portion 12, engagement hole 15, and projection 16 form a locking mechanism 17 on the left side. The locking mechanisms operate to lock the cover 2 to the body 3 of the electrophotographic printer 1 when the cover 2 is closed.

Figure 5:
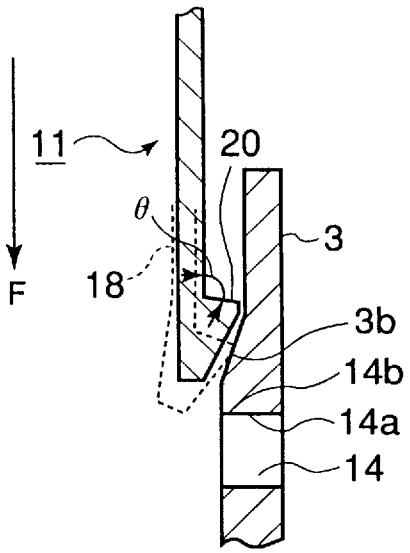
FIG. 5 is a cross-sectional side view showing the positional relation between the strip-shaped portion and the corresponding, engagement hole when locking.
Figure 6:
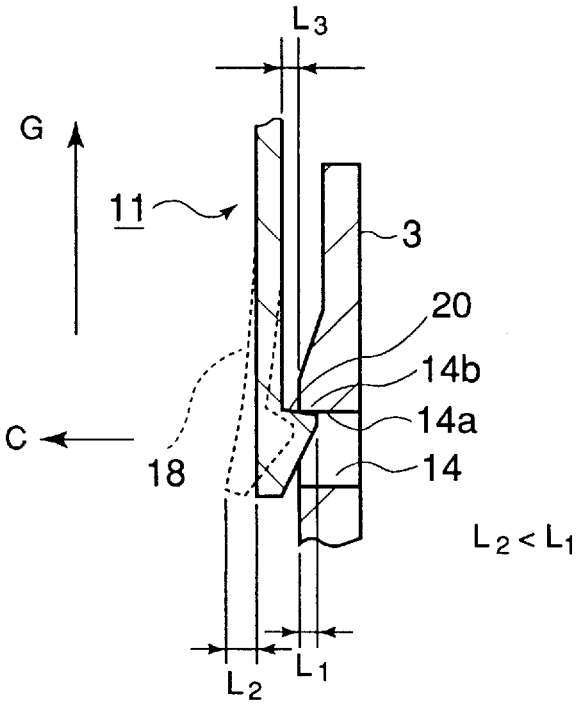
FIG. 6 is another cross-sectional side view showing the positional relation between the strip-shaped portion and the corresponding engagement hole when unlocking.
Figure 10:
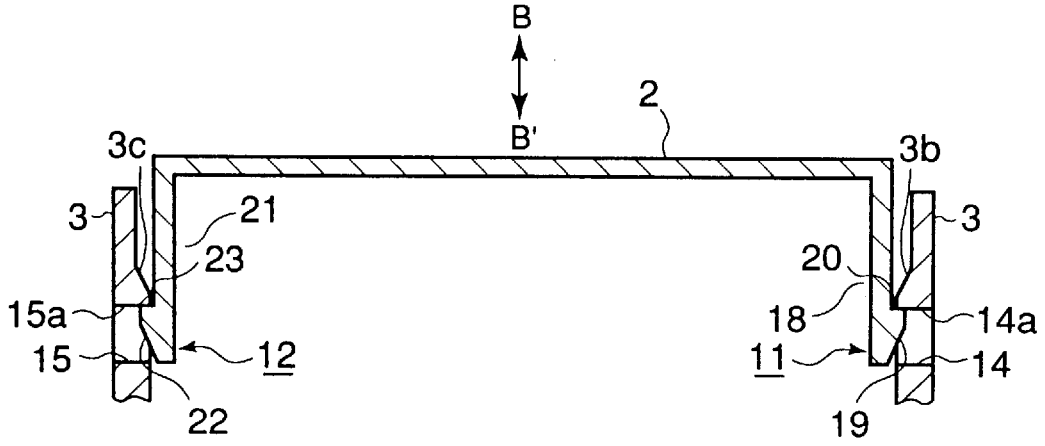
FIG. 10 is a cross-sectional view showing the positional relation between the cover and the body when the cover is closed.
Figure 11:
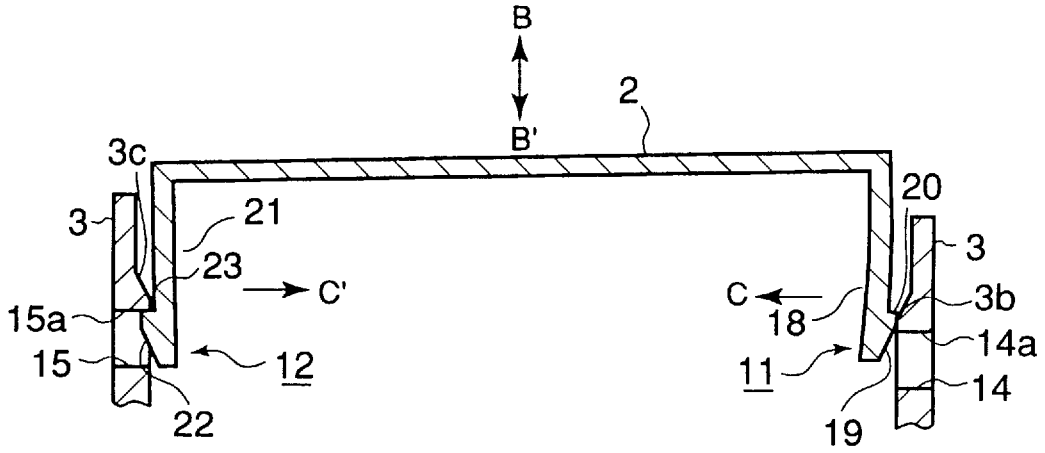
FIG. 11 is another cross-sectional view showing he positional relation between the cover and the body.
Figure 12:
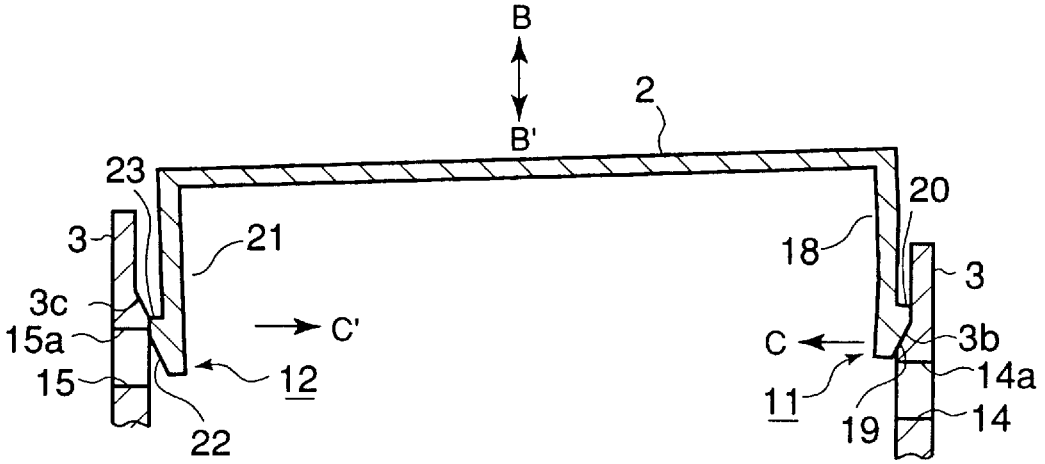
FIG. 12 is a cross-sectional view showing the relation between the cover and the body.

The locking operation of the locking mechanism 17 will be described as follows: The operation is described with reference to only the one on the right side since locking mechanisms 17 on the left and right sides of the electrophotographic printer 1 are the same construction and operate much the same way. FIGS. 5–6 are cross-sectional side views showing the positional relations between the strip-shaped portion 11 and engagement hole 14. FIGS. 10–12 are cross-sectional side views showing the positional relation between the cover 2 and the body 3.

When closing the cover 2, the cover 2 is rotted in the A' direction in FIG. 1 so that the tapered portions 19 and 22 of the strip-shaped portions 11 and 12 abut the complimentary tapered portions 3*b* and 3*c*, respectively. As the cover 2 is further rotated in the B' direction (closing direction) in FIG. 11, the tapered portion 19 moves in a direction shown by arrow F to ride on the tapered portion 3*b* as shown in FIG. 5 while at the same time the resilient portion 18 is yieldably deformed as depicted by dotted lines. Thus, the resilient portions 18 and 21 flex inwardly in directions shown by arrows C and C' in FIG. 12. When the cover 2 is further rotated in the B' direction, the engaging surface 20 advances past the wall 14*a* of the engagement hole 14 as shown in FIG. 6, thereby snapping into the engagement hole 14 as shown in solid lines (locking position). The resilient portions 18 regains its original position so that the cover 2 is completely closed in locked engagement with the body 3. It is to be noted that the engaging surface 20 is not fully in the engagement hole 14 after the cover 2 has been completely closed. The engaging surface 20 has a first area that extends into the engagement hole 14 by a distance L1 and and a second area that is out of the engagement hole 14 by a distance L3.

Figure 7:
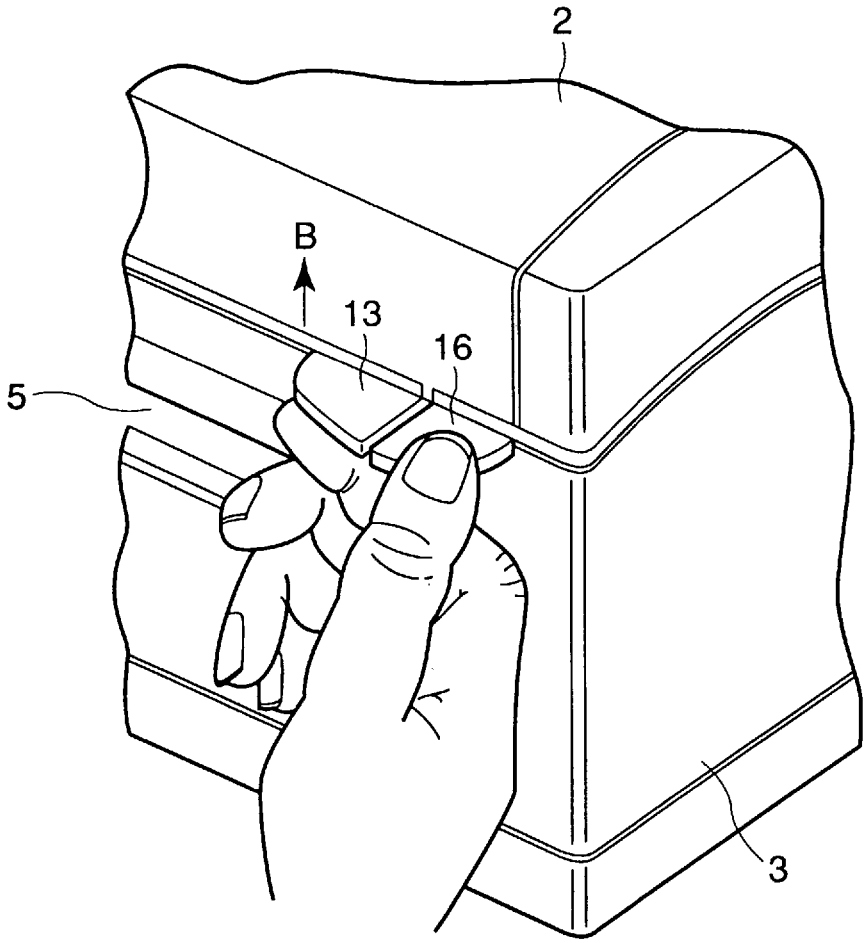
FIG. 7 is a perspective view showing unlocking operation of the locking mechanism of the invention.
Figure 8:
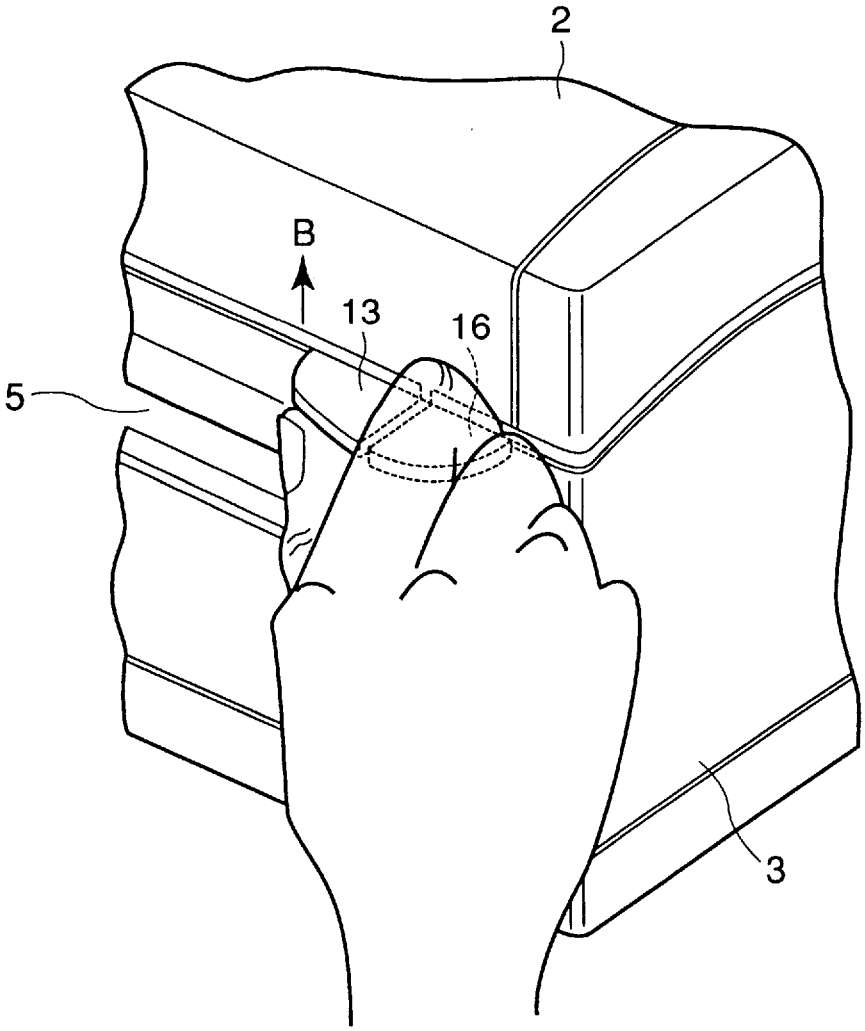
FIG. 8 is another perspective view showing unlocking operation of the locking mechanism of the invention.

The unlocking operation of the locking mechanism 17 will be described as follows:

FIGS. 7 and 8 are perspective views showing the unlocking operation of the locking mechanism 17.

When the cover 2 is completely closed, the strip-shaped portions 11 and 12 engage the engagement holes 14 and 15, respectively, as shown in FIG. 10, so that the cover 2 is at a closing position.

Referring to FIG. 7, when the operator wants to open the cover 2, the operator presses down the projection 16 from above with the thumb of his right hand and pushes up the projection 13 with the index finger from under the projection 13. Alternatively, as shown in FIG. 8, the cover 2 may be opened by pressing down the projection 16 with the index finger of his right hand from above and pushes up the projection 13 with the thumb from under the projection 13 in the B direction (opening direction).

Figure 9:
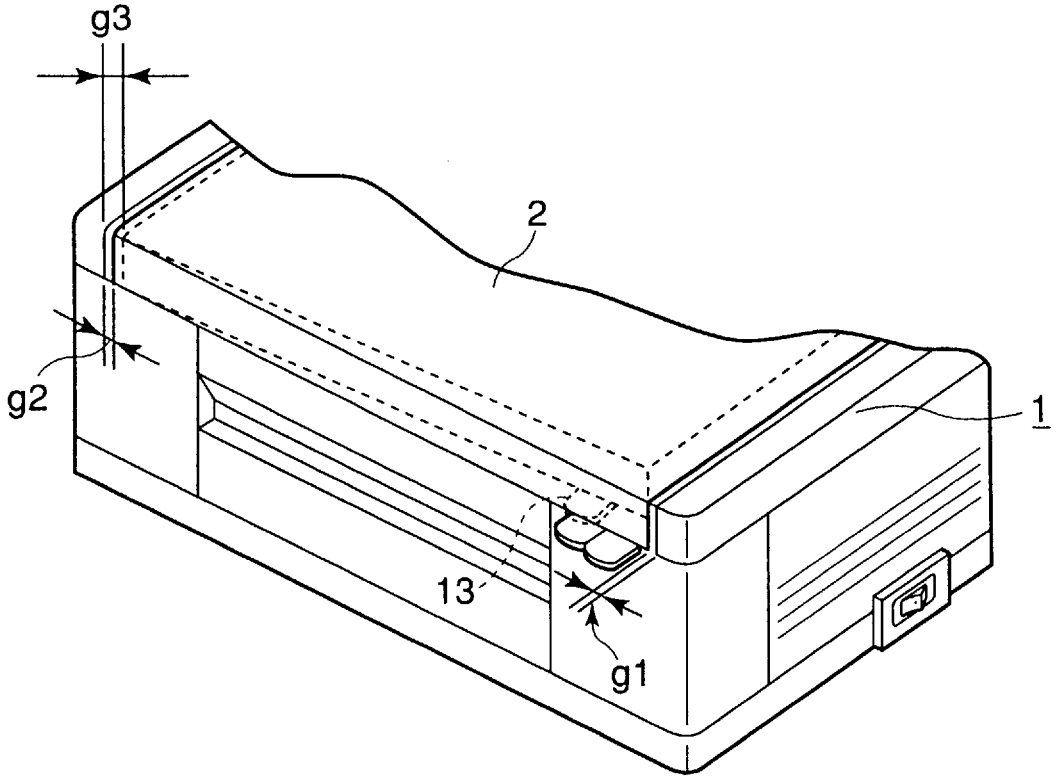
FIG. 9 is another perspective view showing the positions of the cover relative to the body when the cover is closed and when the cover is being opened.

Referring to FIG. 6, when the cover 2 is completely closed, an engaging surface 20 of the strip-shaped portion 11 snaps into the engagement hole 14 by a distance L1. Thus, the cover 2 is placed in position relative to the body 1 with gaps g1 and g2 between the body 1 as shown in FIG. 9. The gaps g1 and g2 are substantially the same magnitude. The engaging surface 20 is preferably slightly at an angle with the wall 14*a*, i.e., angle θ shown in FIG. 5 is greater than 90°, so that the engaging surface 20 can easily move out of engagement with an upper wall 14*a* of the engagement hole 14 if a sufficient amount of upward force is concentrated on the strip-shaped portion 11. The cover 2 and body 3 are usually formed by molding and a corner 14*b* of the body 3 is slightly radiused.

When the operator applies a force in an upward direction shown by arrow B in FIGS. 7 and 8 in order to open the cover 2, the force acting on the locking surface 20 in contact with the corner 14*b* causes the strip-shaped portion 11 to deform as depicted by dotted Lines in FIG. 6 due to the fact that the locking surface 14 extends outwardly of the engagement hole 14 by a distance L3. The strip-shaped portion 11 yieldably deforms in a direction shown by arrow C in FIG. 6, so that the engaging surface 20 slides over the corner 14*b* of the body 3 outwardly of the engagement hole 14. The slightly radiused corner 14*b* allows the locking surface to smoothly slide.

Further application of the force in a direction shown by arrow G in FIG. 6 causes the resilient portion 18 to sufficiently flex, so that the locking projection 20 to disengage from the wall 14*a* of the hole 14, thereby unlocking the cover 2 at the right hand side of the cover 2. As shown in FIG. 6, the engaging surface 20 displaces laterally in the C direction by a distance L2, which is longer than the distance L1 in FIG. 6. This ensures that the locking surface 20 moves completely out of the hole 14.

The engaging surface 23 of the strip-shaped portion 12 on the left side of the body 3 is also engaged with an upper wall 15*a* of the engagement hole 15 by the distance L1 in a manner similar to that in FIG. 6. Upon unlocking the cover 2 at the right hand side thereof, the operator pushes up the cover 2 as shown by dotted lines in FIG. 9, while still holding the edge of the cover 2 with his hand so that the left side of the cover 2 is forcibly lifted in the B direction.

Then, the engaging surface 23 of the strip-shaped portion 12 pushes the wall 15*a* of the engagement hole 15 as shown in FIG. 11, causing the resilient portion 21 to yieldably flex in the C' direction. Thus, the gap g2 between the cover 2 and the left side of the body 1 increases to a larger magnitude g3 as shown in FIG. 9. This larger gap g3 helps the cover 2 disengage from the body 1. The engaging surface 23 displaces laterally in the C' direction in FIG. 12 by the distance L2 in a manner similar to that shown in FIG. 10, the distance L2 being longer than the distance L1. This ensures that the locking surface 23 moves completely out of the engagement hole 15. Due to the flexing of the strip-shaped portion 12, the locking surface 23 snaps out of the engagement with the upper wall 15*a* of the engagement hole 15 as shown in FIG. 12, thereby unlocking the cover 2 at the left-hand side of the cover 2. The operator pushes up the cover 2 while still holding the edge of the cover 2 with his hand, so that the cover 2 is subsequently rotated in the A direction shown in FIG. 1 to fully open the cover 2.

As mentioned above, the present invention is of the construction where one of the two locking mechanisms is first unlocked from the body 3 by manually operating projections 13 and 16, and subsequently pushing up the cover 2 near the unlocked mechanism side so that the other end of the cover subsequently moves out of locked engagement with the body 3. The locking mechanism can be easily manipulated by one hand to unlock and open the cover 2, improving operability of the locking mechanism. Forming the strip-shaped portions 11 and 12, projection 13, and cover 2 in one piece construction simplifies the construction of the locking mechanism 17 providing space saving effect. This leads to a lighter weight smaller sized printer.

Second Embodiment

Figure 13:
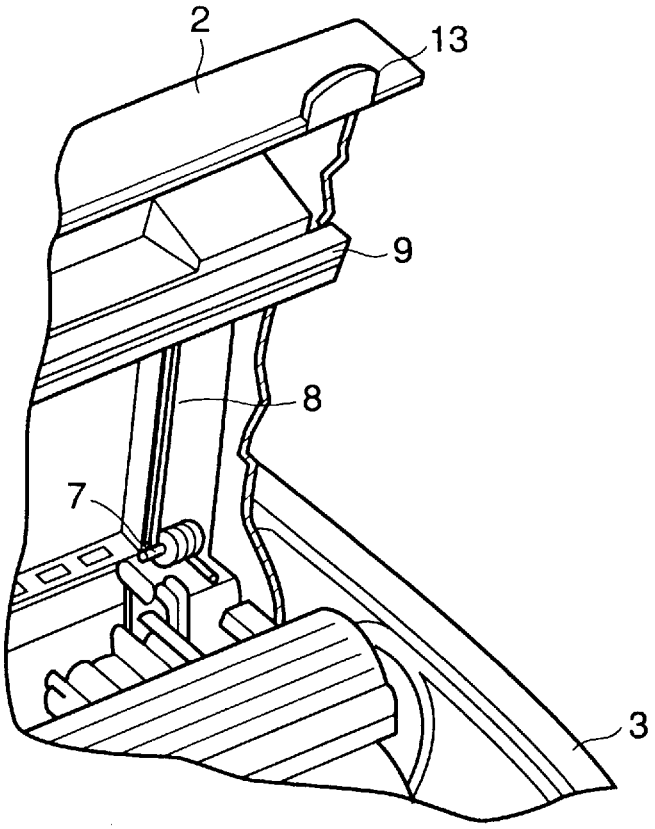
FIG. 13 is a perspective view of another embodiment.

A second embodiment of the present invention will be described. FIG. 13 is an enlarged partially cut away perspective view of an area E shown in FIG. 1 as seen from a direction shown by arrow D, and shows the second embodiment of the invention.

Referring to FIG. 13, the cover 2 is pivotally mounted on the supporting shaft 7 on which a torsion spring 8 is mounted so as to urge the cover 2 in the A direction. The rest of the construction is the same as that of the electrophotographic printer 1 and description thereof is omitted.

The unlocking operation of the electrophotographic printer 1 utilizing the torsion spring 8 will be described. When the user operates, as shown in FIG. 7, the projections 13 and 16 to unlock the locking mechanism 17 at the front right-hand side of the printer 1, the torsion spring 8 urges the cover 2 to rotate in the B direction.

At this time, the left-hand side of the cover 2 is simultaneously pushed up in the B direction so that the engaging surface 23 of the strip-shaped portion 12 presses the wall 15*a* of the engagement hole 15, the resilient portion 21 of the strip-shaped portion 12 yieldably flexing in the C' direction. The engaging surface 23 displaces laterally in the C' direction by the distance L2 shown in FIG. 10 which is longer than the distance L1. This ensures that the locking hook 12 moves completely out of the hole 15. Due to the flexing of the resilient portion 21, the engaging surface 23 disengages from the wall 15*a* of the engagement hole 15 as shown in FIG. 13, thereby unlocking the cover 2 at the left-hand side of the cover 2. The operator pushes up the cover 2 white still holding the edge of the cover 2 with his hand, so that the cover 2 is rotated in the A direction shown in FIG. 1 to fully open the cover 2.

The simple operation of the projections 13 and 16 allows the cover 2 to be quickly and easily opened and is therefore particularly advantageous when the user or service personnel opens the cover 2 to replace the image process cartridge 10.

What is claimed is:

1. An apparatus having a body and a cover fittable to the body, the body and the cover each having front and rear portions respectively adjacent each other when the cover is fitted to the body, the body and the cover each also having first and second opposing side portions respectively adjacent each other when the cover is fitted to the body, the apparatus further having a locking mechanism for releasably locking the cover to the body when the cover is fitted to the body, the locking mechanism comprising:

a first projection formed on the cover adjacent the first side portion thereof, the first projection projecting outwardly from the cover;

a first engagement portion formed on one of the body and the cover at the first side portion thereof adjacent the first projection when the cover is fitted to the body, the first engagement portion engaging the other of the body and the cover to releasably lock the cover to the body at the first side portion thereof when the cover is fitted to the body;

a second, opposing engagement portion formed on one of the body and the cover at the second side portion thereof, the second engagement portion engaging the other of the body and the cover to releasably lock the cover to the body at the second side portion thereof when the cover is fitted to the body;

the cover being marginally displaceable relative to the body in opposing first and second directions toward the second and first side portions of the body, respectively;

the cover being moved in a closing direction to fit the cover to the body and engage the first and second engagement portions;

the first projection being urged in an opening direction to disengage the first engagement portion and unlock the cover from the body at the first side portion;

the first projection thereafter being moved further in the opening direction to cause a gap between the cover and the body at the second side portion to increase in a direction substantially perpendicular to the opening direction, and subsequently to disengage the second engagement portion and unlock the cover from the body at the second side portion.

2. The apparatus of claim 1 further comprising a second projection formed on the body adjacent the first projection when the cover is fitted to the body, the first and second projections being simultaneously operated with only one hand to open the cover.

3. The apparatus of claim 2 wherein the rear portions of the body and cover are away from the first and second engagement portions.

4. The apparatus of claim 3 further including a torsion spring urging the cover in the opening direction.

5. The apparatus of claim 1 wherein the rear portions of the body and cover are away from the first and second engagement portions.

6. The apparatus of claim 5 further including a torsion spring urging the cover in the opening direction.

7. The apparatus of claim 1 wherein each of the first and second engagement portions comprises a first member formed on the cover and further comprises a second member formed on the body, the first member snapping into locking engagement with the second member when the cover is fitted to the body, the first member of the first engagement portion snapping out of locking engagement with the second member thereof when a force of a predetermined magnitude is applied to the first projection in the first direction, the first member of the second engagement portion snapping out of locking engagement with the second member thereof after the first engagement portion is disengaged.

8. The apparatus of claim 7 wherein each first member is a resilient strip extending from the cover in the closing direction, and each second member is a wall of the body and a recess defined therein, the recess extending transversely with respect to the closing direction, the resilient strip engaging the wall, resiliently deforming, and subsequently snapping into locking engagement with the recess when the cover is fitted to the body, the resilient strip of the first engagement portion resiliently deforming to snap out of the respective recess when the first projection is moved in the first direction.

9. The apparatus of claim 1 wherein the cover is pivotally mounted to the body at a pivot axis at the rear portion thereof, the cover being marginally displaceable in the first and second directions along the pivot axis.

10. The apparatus of claim 9 further comprising a second projection formed on the body adjacent the first projection when the cover is fitted to the body, the first and second projections being simultaneously operated with only one hand to open the cover.

11. The apparatus of claim 10 wherein the rear portions of the body and cover are away from the first and second engagement portions.

12. The apparatus of claim 11 further including a torsion spring mounted about the pivot axis and urging the cover in the opening direction.

13. The apparatus of claim 9 wherein the rear portions of the body and cover are away from the first and second engagement portions.

14. The apparatus of claim 13 further including a torsion spring mounted about the pivot axis and urging the cover in the opening direction.

15. The apparatus of claim 9 wherein each of the first and second engagement portions comprises a first member formed on the cover and further comprises a second member formed on the body, the first member snapping into locking engagement with the second member when the cover is fitted to the body, the first member of the first engagement portion snapping out of locking engagement with the second member thereof when a force of a predetermined magnitude is applied to the first projection in the first direction, the first member of the second engagement portion snapping out of locking engagement with the second member thereof after the first engagement portion is disengaged.

16. The apparatus of claim 15 wherein each first member is a resilient strip extending from the cover in the closing direction, and each second member is a wall of the body and a recess defined therein, the recess extending transversely with respect to the closing direction, the resilient strip engaging the wall, resiliently deforming, and subsequently snapping into locking engagement with the recess when the cover is fitted to the body, the resilient strip of the first engagement portion resiliently deforming to snap out of the respective recess when the first projection is moved in the first direction.

* * * * *